US011946374B2

(12) United States Patent
Tang et al.

(10) Patent No.: US 11,946,374 B2
(45) Date of Patent: Apr. 2, 2024

(54) OMNI-DIRECTIONAL HORIZONTALLY ORIENTAED DEFLECTING TOOL FOR COILED TUBING

(71) Applicant: Southwest Petroleum University, Chengdu (CN)

(72) Inventors: Yang Tang, Chengdu (CN); Miantao Guan, Chengdu (CN); Yulin Zhang, Chengdu (CN); Peng Zhao, Deyang (CN); Guorong Wang, Chengdu (CN); Jinhai Zhao, Beijing (CN); Qingyou Liu, Chengdu (CN); Jinzhong Wang, Chengdu (CN); Xiang Gao, Chengdu (CN); Yufa He, Beijing (CN); Hu Deng, Beijing (CN); Liming Fan, Deyang (CN); Rutao Ma, Beijing (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/347,179

(22) Filed: Jul. 5, 2023

(65) Prior Publication Data

US 2024/0044211 A1 Feb. 8, 2024

(30) Foreign Application Priority Data

Aug. 8, 2022 (CN) ..... 202210946195.3

(51) Int. Cl.

| | |
|---|---|
| ***E21B 7/06*** | (2006.01) |
| ***E21B 23/00*** | (2006.01) |
| ***E21B 23/04*** | (2006.01) |

(52) U.S. Cl.
CPC ..... *E21B 7/061* (2013.01); *E21B 23/006* (2013.01); *E21B 23/0411* (2020.05)

(58) Field of Classification Search
CPC ..... E21B 7/061; E21B 23/006; E21B 23/041
See application file for complete search history.

(56) References Cited

U.S. PATENT DOCUMENTS 5,335,737 A * 8/1994 Baugh ..... E21B 7/061 175/81

FOREIGN PATENT DOCUMENTS

| | | | |
|---|---|---|---|
| CN | 202266215 | U | 6/2012 |
| CN | 102817575 | A | 12/2012 |
| CN | 110331957 | A | 10/2019 |
| CN | 110984859 | A | 4/2020 |
| CN | 216974789 | U | 7/2022 |

* cited by examiner

*Primary Examiner* — Tara Schimpf
*Assistant Examiner* — Lamia Quaim

(57) ABSTRACT

The disclosure relates to an omni-directional horizontally oriented deflecting tool for a coiled tubing, which includes an inner central pipe, an outer central pipe, a conical outer cylinder, a piston outer cylinder, an anchoring mechanism, a sealing mechanism, a reversing mechanism and a steering mechanism. The anchoring mechanism includes a cone, an O-shaped sealing ring I, a cone spring, a slip, a slip spring, a slip seat, a claw I and a pin shaft I, and the sealing mechanism includes a piston, an O-shaped sealing ring II, a claw II, a pin shaft II, an upper rubber cylinder seat, a rubber cylinder, a connecting cylinder, a lower rubber cylinder seat and a gasket.

7 Claims, 11 Drawing Sheets

OMNI-DIRECTIONAL HORIZONTALLY ORIENTAED DEFLECTING TOOL FOR COILED TUBING

CROSS-REFERENCE TO RELATED APPLICATIONS

This application claims priority to Chinese Application No. 202210946195.3, filed on Aug. 8, 2022, entitled "OMNI-DIRECTIONAL HORIZONTALLY ORIENTAED DEFLECTING TOOL FOR COILED TUBING". These contents are hereby incorporated by reference.

TECHNICAL FIELD

The disclosure relates to the field of deep-sea oil and gas resources exploitation equipment, and specifically designs an omni-directional horizontally oriented deflecting tool for a coiled tubing.

BACKGROUND

Gas hydrate, also known as flammable ice, is widely distributed. In general, hydrate mainly exists in a non-rock-forming stratum within 300 m below a seafloor. At present, existing gas hydrate exploitation methods involve a depressurization method, a thermal excitation method, a replacement method, an inhibitor method and a solid fluidization exploitation method. The solid fluidization exploitation method is a new gas hydrate mining method in the non-rock-forming stratum first proposed and adopted in China. In order to realize multi-level and multi-directional large-scale exploitation of natural gas hydrate, shallow gas and deep gas, and improve recovery efficiency and reduce exploitation cost, it is one of the most effective ways to use directional wells (horizontal wells) for mining operations.

Underground coal gasification is new underground coal mining technology with characteristics of good safety, less investment, high benefit and less pollution, which is mainly applied in coal gasification with a buried depth of 1000 to 3000 m. In its drilling gasification mining technology, directional well (horizontal well) drilling technology is required to construct gasification channels and gas-collecting channels. Horizontal well technology has achieved a breakthrough in a bottleneck of the underground coal gasification technology and opened a new milestone in the underground coal gasification technology.

At present, tools for drilling directional wells (horizontal wells) mainly include a rotary steering tool and a radial horizontal well steering tool. However, according to its working principle, the rotary steering tool can't meet requirements for application in deflection for a non-diagenetic and weakly consolidated gas hydrate layer in a subsea shallow layer, and the radial horizontal well steering tool can't meet requirements of a solid fluidization exploitation process of the natural gas hydrate, which is as follows.

(1) The rotary steering tool serves to control a piston by controlling drilling fluid so that the piston stretches out and pushes against a borehole wall, and a drilling direction of the tool is changed by a reaction force from the borehole wall. However, most of the gas hydrates in the subsea shallow layer have poor consolidation strength, which are argillo arenaceous silt with low strength, a loose structure and ease of being broken. The natural gas hydrate can't support a force from the piston, so the existing rotary steering tool can't be applied to the non-diagenetic and weakly consolidated gas hydrate stratum in a subsea shallow layer.

(2) Radial boreholes can be drilled at different depths and in different directions in a original shaft by using the radial horizontal well guiding tool, but the boreholes drilled by using the radial horizontal well guiding tool are too small to meet requirements of the solid fluidization exploitation process of the natural gas hydrate and construction requirements of underground coal gasification projects.

(3) Drilling with a radial horizontal well steering gear requires a large reaming size, which may increase construction difficulty, risk and cost during marine exploration drilling and underground coal gasification drilling.

(4) In order to save exploration cost and reduce drilling risk, tripping-in and out times of a tubing string are reduced as much as possible during natural gas hydrate exploration and underground coal gasification so as to realize large-scale mining of a hydrate layer and multi-channel construction of the underground coal gasification with a single tripping-in of the tubing string. At present, a deflecting tool does not have an underground transposition function.

Therefore, it is necessary to propose an omni-directional horizontally oriented deflecting tool for a coiled tubing, so that it can serve to deflect in a non-diagenetic and low-strength stratum and meet requirements of natural gas hydrate, underground coal gasification, shallow gas and deep gas exploitation. Therefore, in view of problems existing in existing steering tools and other tools and requirements of the solid fluidization exploitation process, it is urgent to solve problems such as applying the deflecting tool to the non-diagenetic and low-strength stratum and meeting requirements of the solid fluidization exploitation process, such as realizing of multi-level and multi-directional large-scale exploitation, reducing of tripping-in times, improving of recovery efficiency and reducing of mining cost.

SUMMARY OF THE INVENTION

In view of a problem of an existing steering tool being not suitable for applying to a non-diagenetic and low-strength stratum, an object of the disclosure is to provide an omni-directional horizontally oriented deflecting tool for a coiled tubing, so as to solve a problem that application conditions of the existing steering tool are not comprehensive and cannot meet requirements of a solid fluidization exploitation process and construction requirements of an underground coal gasification project. In this disclosure, a tool is anchored to a casing and sealing is made at the same time by using an anchoring mechanism, a sealing mechanism and a steering mechanism and controlling drilling fluid, then a drill bit and a coiled tubing are tripped in, and deflection is realized through eccentric arrangement of a steering cylinder and an internal bend, and the tool does not exert an acting force on the stratum in a whole process, thus solving a problem that an existing rotary steering tool needs to apply an acting force on the non-diagenetic and low-strength stratum but the non-diagenetic and low-strength stratum cannot provide supporting for the force exerted by the rotary steering tool. In this disclosure, the steering mechanism is adopt to bend the coiled tubing to deflect through cooperation of the coiled tubing and the drill bit with the steering mechanism, so that a borehole with a large size can be formed, requirements of the solid fluidization exploitation process can be met, which is suitable for drilling horizontal wells in underground coal gasification and solves a problem that a borehole drilled by an existing radial horizontal well steering tool is small. In the disclosure, with design of an internal structure of the steering cylinder and setting of an installation position, the tool does not need a large reaming diameter in deflecting, and mining difficulty and construction risk are reduced. In the disclosure, with a transposition mechanism, the drill bit can serve to drill in different directions at a same horizontal height without taking the tool out of the casing, so as to ensure that tripping-in times of the tool are reduced and mining efficiency is improved.

The disclosure adopt following technical schemes to solve the technical problem. An omni-directional horizontally oriented deflecting tool for a coiled tubing includes an inner central pipe, an outer central pipe, a cone outer cylinder connected with the outer central pipe through a shear pin I, a piston outer cylinder connected with the outer central pipe through a shear pin II, an anchoring mechanism, a sealing mechanism, a transposition mechanism and a steering mechanism. An upper part and a middle-lower part of the outer central pipe are provided with threaded holes, a middle-upper part and a lower part thereof are provided with circumferential circular through holes, and outer walls of a middle part and the lower part thereof are provided with circumferential rectangular grooves, an inner side of a lower part of each rectangular groove is provided with a circular hole, and a segment of rectangular groove is provided in both sides of a lower part of the outer central pipe. The anchoring mechanism includes a cone, an O-shaped seal ring I, a cone spring, a slip, a slip spring, a slip seat, a claw I and a pin shaft I. An upper part of the cone is provided with a step and a lower part thereof is provided with a conical surface and is circumferentially provided with three rectangular through grooves uniformly, the cone is installed between the outer central pipe and the cone outer cylinder, an outer side of an upper part of the slip seat is provided with external thread I; and an inner side of the upper part of the slip seat is provided with two annular grooves, and the slip seat is circumferentially provided with three groups of rectangular through grooves and an inner side of the slip seat is provided with three circular grooves. The slip seat is connected to the cone outer cylinder through thread, the O-shaped seal ring I is arranged between the slip seat and the cone and installed in the annular groove at the inner side of the upper part of the slip seat, the cone spring is arranged between the rectangular through groove at the lower part of the cone and the slip seat, the slip is installed in the rectangular through groove of the slip seat, and the upper part of the slip is in contact with the conical surface of the lower part of the cone, the slip spring is arranged between the slip and the circular groove at the inner side of the slip seat, and the claw I is installed in the rectangular groove of the middle part of the outer wall of the outer central pipe through the pin shaft I. The sealing mechanism includes a piston, an O-shaped sealing ring II, a claw II, a pin shaft II, an upper rubber cylinder seat, a rubber cylinder, a connecting cylinder, a lower rubber cylinder seat and a gasket. An upper end of the piston is an annular frustum, a lower part of the annular frustum is provided with four annular bosses with a certain radian, the piston is sleeved between the outer central pipe and the piston outer cylinder, the O-shaped sealing ring II is arranged between the annular frustum at the upper end of the piston and the piston outer cylinder, and the claw II is installed in the rectangular groove of the lower part of the outer wall of the outer central pipe through the pin shaft II, an inner side of an upper part of the upper rubber cylinder seat is provided with thread II, and an inner side of the upper rubber cylinder seat is provided with thread III, the upper rubber cylinder seat is provided with four annular through grooves with a certain radian, the upper rubber cylinder seat is connected to the piston outer cylinder through thread, the annular boss of the piston is installed in cooperation with the annular through groove of the upper rubber cylinder seat, the connecting cylinder is sleeved outside the outer central pipe and connected to the upper rubber cylinder seat through thread, the gasket is sleeved outside the connecting cylinder and is in contact with the upper rubber cylinder seat, the rubber cylinder is sleeved outside the connecting cylinder and is in contact with the gasket, and the lower rubber cylinder seat is connected to the connecting cylinder through thread. The transposition mechanism includes a lower outer cylinder, a transposition spring, a thrust bearing and a transposer. The lower outer cylinder is connected to the lower rubber cylinder seat through thread, the transposition spring is arranged between the outer central pipe and the lower outer cylinder, an upper end of the transposition spring is in contact with the lower rubber cylinder seat and the lower end of the transposition spring is in contact with the thrust bearing, the thrust bearing is sleeved between the outer central pipe and the lower outer cylinder, an inner side of a middle of the transposer is provided with six groups of transposition rails, and each of the six groups of transposition rails includes a rail I, a rail II, a rail III and a rail IV, the transposer is installed in the lower outer cylinder, and an upper end face of the transposer is in contact with a lower end face of the thrust bearing. The steering mechanism includes a steering cylinder frame, a steering cylinder and a pin shaft III. The steering cylinder frame is connected to a lower end of the transposer through thread, and the steering cylinder is installed between the steering cylinder frames through a pin shaft, an upper part and an upper-middle part of the inner central pipe are provided with circumferential circular through holes, a middle-lower part and a lower part thereof are provided with circumferential pin holes, the pins are installed in the pin holes, the pin of the middle-lower part of the inner central pipe are matched with the rectangular groove of the lower part of the outer central pipe, the pin of the middle-lower part of the inner central pipe move axially along the rectangular groove of the lower part of the outer central pipe, the pin of the middle-lower part of the inner central pipe is installed in cooperation with the transposition rail, the pin of the middle-lower part of the inner central pipe slides in the transposition rail, and the through hole of the inner central pipe are aligned with the through hole of the outer central pipe.

A lower part of the claw I is provided with a through hole and an upper part thereof is provided with a protrusion.

An outer side of an upper end of the connecting cylinder is provided with thread IV, and an outer side of a lower end of the connecting cylinder is provided with thread V.

An outer side of an upper end of the lower outer cylinder is provided with thread VI and a lower end of the lower outer cylinder is provided with a boss.

An outer side of an upper end of the transposer is provided with a step and an inner side of the lower end of the transposer is provided with thread VII.

An outer side of an upper end of the steering cylinder frame is provided with thread VIII, a lower end of the steering cylinder frame is provided with a rectangular through groove and a lower part of the steering cylinder frame is provided with a circular through hole.

An outer part of the steering cylinder is provided with a arc surface with a certain radian, an inner part of the steering cylinder is provided with a circular channel with a certain curvature, and circular holes are provided outside of two sides of the steering cylinder.

A transposition method of the transposition mechanism includes following steps.

S1, the inner central pipe is moved to trip out the coiled tubing and the drill bit, and the coiled tubing and the drill bit drive the inner central pipe to move axially upwards.

S2, the pin slides and the inner central pipe moves axially upwards, and the pin of the lower part of the inner central pipe slides in the rail I in the transposition rail of the transposer.

S3, the transposer peforms transposition, in which the pin of the low part of the inner central pipe slides into the rail II from the rail I, and the pin of the lower part of the inner central pipe moves axially upwards to drive the transposer to rotate.

S4, transposition is finished, in which after the pin of the lower part of the inner central pipe slides into the rail III from the rail II, tripping out of the coiled tubing and the drill bit is stopped.

S5: the transposition is completed, in which the coiled tubing and the drill bit are tripped in after the transposition is completed, the inner central pipe moves downwards, and the pin of the lower part of the inner central pipe slides from the rail III to the rail IV, so as to perform the transposition once.

S6, repeat the steps S1 to S5 when transposition is performed again until drilling in various directions at a same horizontal height is completed.

Beneficial Effects By adopting the technical scheme, the disclosure has following beneficial technical effects.

(1) The tool is anchored to the casing and sealing is made at the same time by controlling the drilling fluid, then the drill bit and the coiled tubing are tripped in, and deflection is realized through the eccentric arrangement of the steering cylinder and the internal bend, and the tool does not exert an acting force on the gas hydrate stratum in a whole process, which is more suitable for exploitation of the non-diagnostic, weakly consolidated and fragile-structured gas hydrate stratum in a subsea shallow layer than the rotary steering tool.

(2) The coiled tubing is bent to deflect through cooperation of the coiled tubing and the drill bit with the steering mechanism, so that a borehole with a large size can be formed, requirements of the solid fluidization exploitation process and drilling horizontal wells in underground coal gasification can be met.

(3) With design of an internal structure of the steering cylinder and setting of an installation position, the tool does not need a large reaming diameter in deflecting, and mining difficulty and risk, and mining cost are reduced.

(4) In the disclosure, drilling in different directions at the same horizontal height can be realized through the transposition mechanism with a single tripping in of the tubing string, so as to ensure that tripping-in times of the tool are reduced and mining efficiency is improved.

Reference numbers are as follows: 1—Outer Center Tube, 2—Inner Center Tube, 3—Shear Pin I, 4—Cone Outer Cylinder, 5—Jaw I, 6—Pin Shaft I, 7—Cone, 8—O-shaped Seal Ring I, 9—Slip Seat, 10—Cone Spring, 11—Shear Pin Shaft II, 12—Piston Outer Cylinder, 13—Piston, 14—O-shaped Seal Ring II, 15—Upper Rubber Cylinder Seat, 16—Rubber Cylinder, 17—Gasket, 18—Connecting Cylinder, 19—Lower Rubber Cylinder Seat, 20—Lower Outer Cylinder, 21—Transposition Spring, 22—Thrust Bearing, 23—Transporter, 24—Steering Cylinder Frame, 25—Pin Shaft III, 26—Steering Cylinder, 27—Pin Shaft II, 28—Jaw II, 29—Slip Spring, 30—Slip, 31—Coiled Tubing and Drill Bit, 101—Threaded Hole, 102—Through Hole, 103—Rectangular Groove, 104—Circular Hole, 105—Rectangular Groove, 201—Through Hole, 202—Pin Hole, 501—Protrusion, 502—Through Hole, 701—Step, 702—Rectangular Through Groove, 703—Conical Surface, 901—Thread I, 902—Annular Groove, 903—Rectangular Through Groove, 904—Circular Groove, 1301—Annular Frustum, 1302—Annular Boss, 1501—Thread II, 1502—Thread III, 1503—Annular Through Groove, 1801—Thread IV, 1802—Thread V, 2001—Thread VI, 2002—Boss, 2301—Boss, 2302—Rail I, 2303—Rail II, 2304—Rail III, 2305—Rail IV, 2306—Thread VII, 2401—Thread VIII, 2402—Circular Through Hole, 2403—Rectangular Through Groove, 2601—Arc Surface, 2602—Circular channel, 2603—Circular Hole.

DETAILED DESCRIPTION OF PREFERRED EMBODIMENTS

The disclosure will be further described with reference to the drawings in the following.

Figure 1:
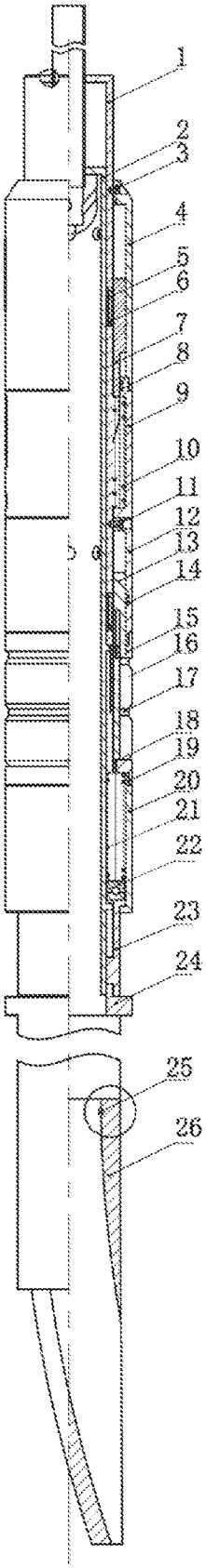
FIG. 1 is a half sectional view of a tool according to the present disclosure.
Figure 2:
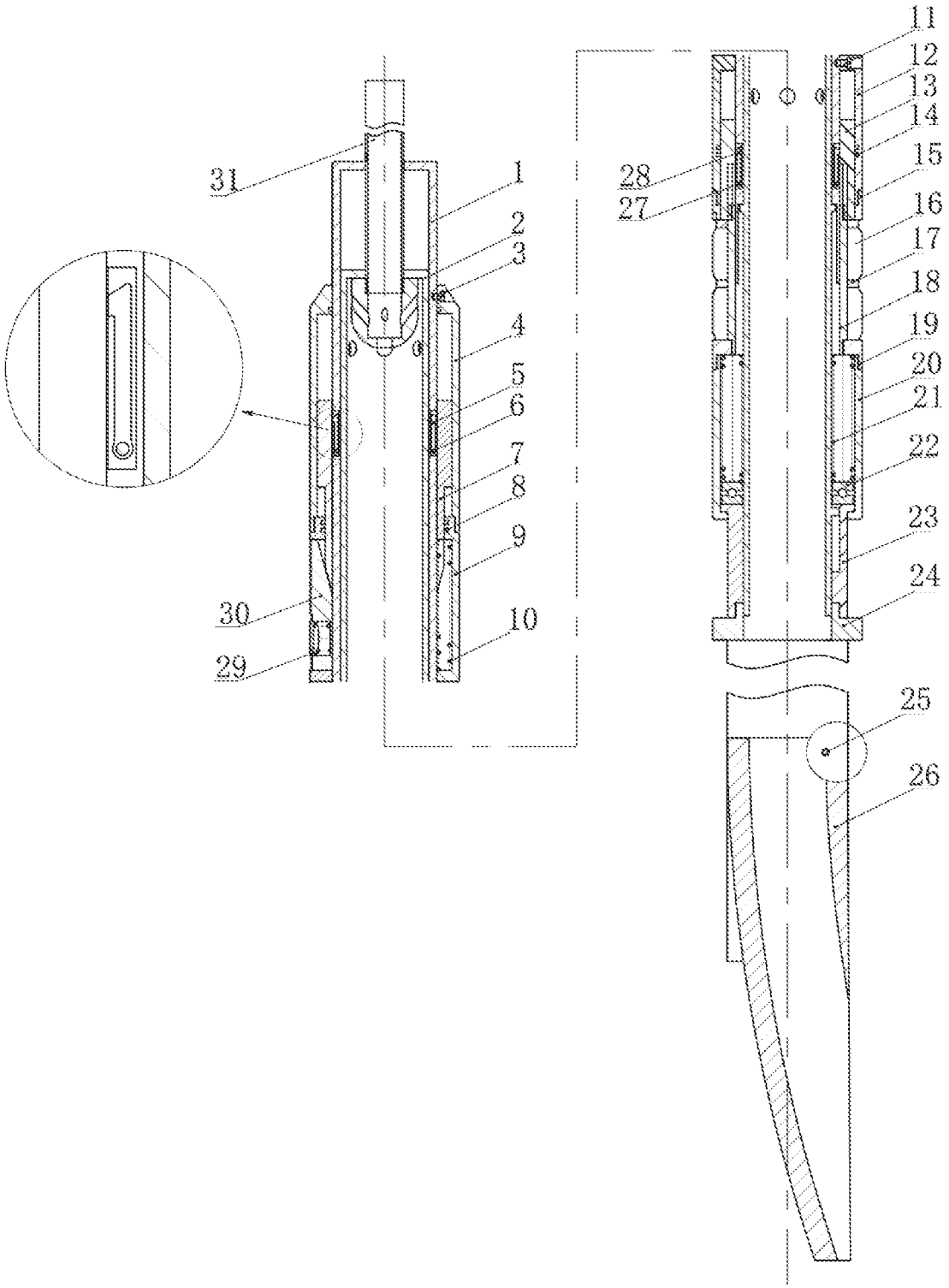
FIG. 2 is an overall sectional view of the tool according to the present disclosure.
Figure 3:
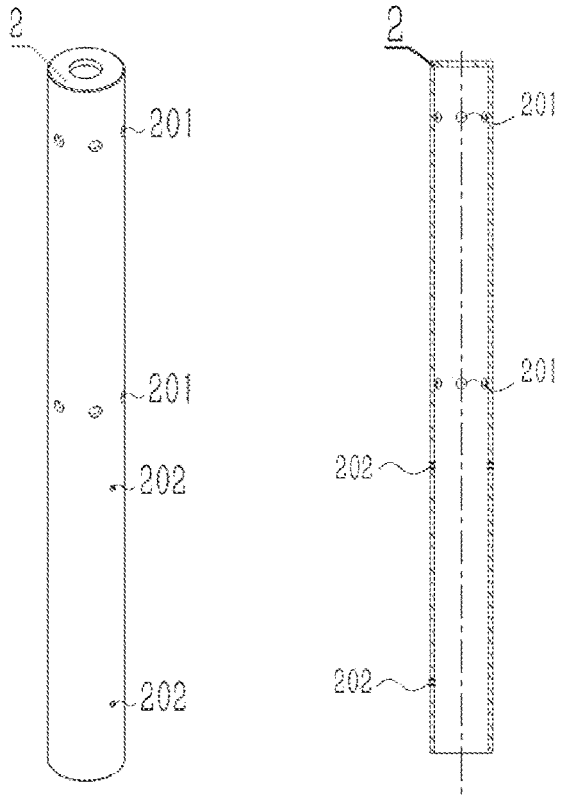
FIG. 3 is a structural diagram of an inner central pipe according to the present disclosure.
Figure 4:
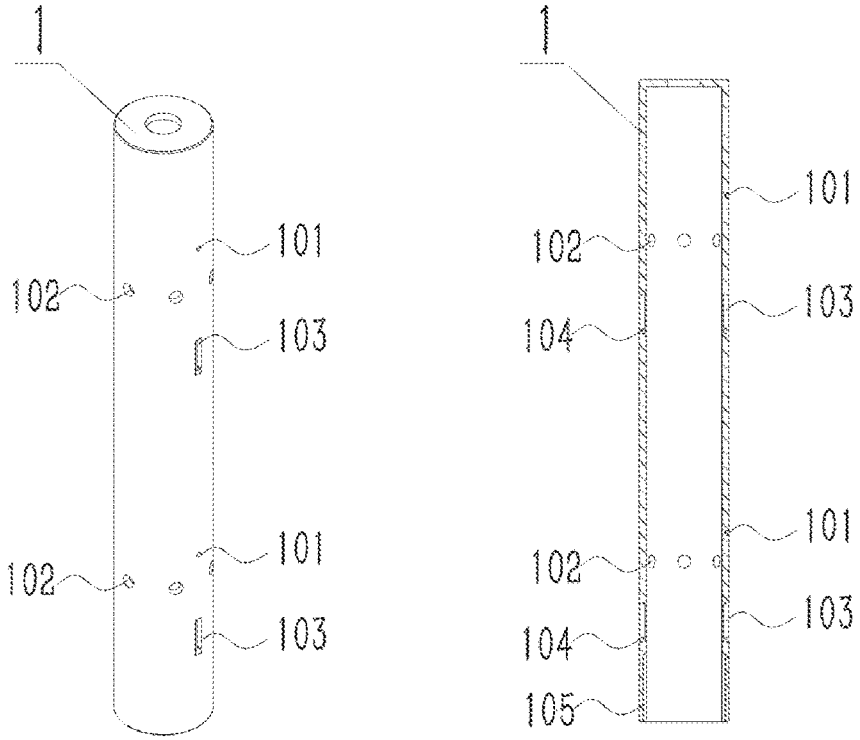
FIG. 4 is a structural diagram of an outer central pipe according to the present disclosure.
Figure 5:
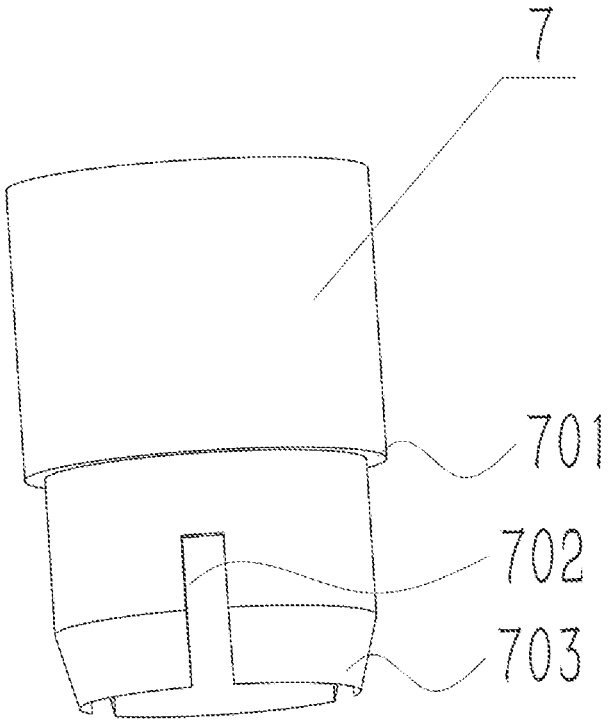
FIG. 5 is an outside view of a cone according to the present disclosure.
Figure 6:
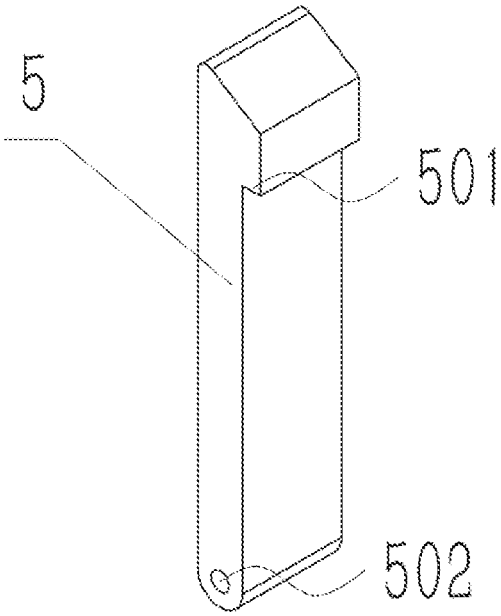
FIG. 6 is an outside view of a claw according to the present disclosure.
Figure 7:
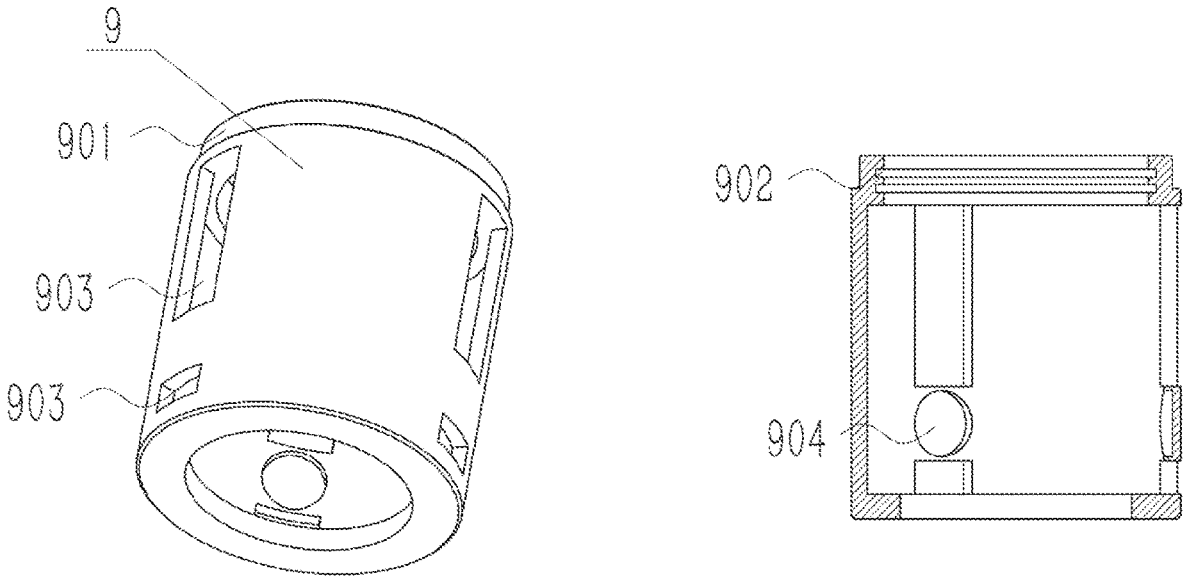
FIG. 7 is a structural diagram of a slip seat according to the present disclosure.
Figure 8:
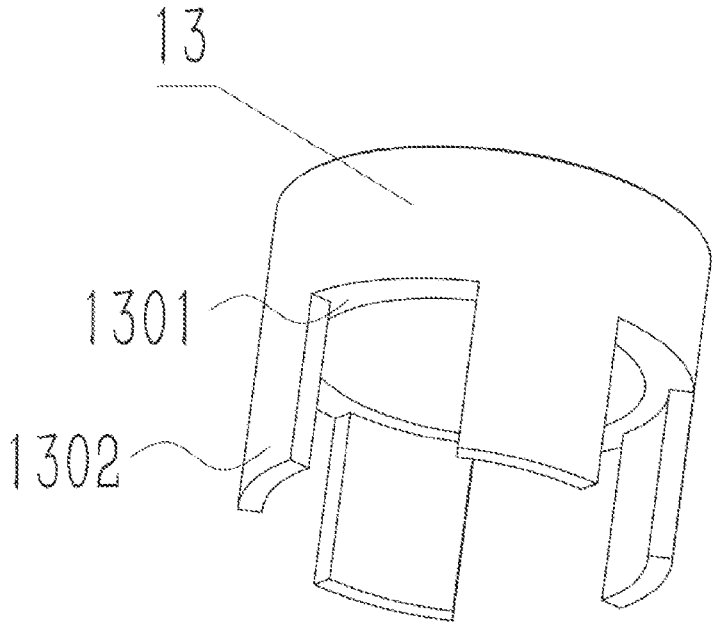
FIG. 8 is an outside view of a piston according to the present disclosure.
Figure 9:
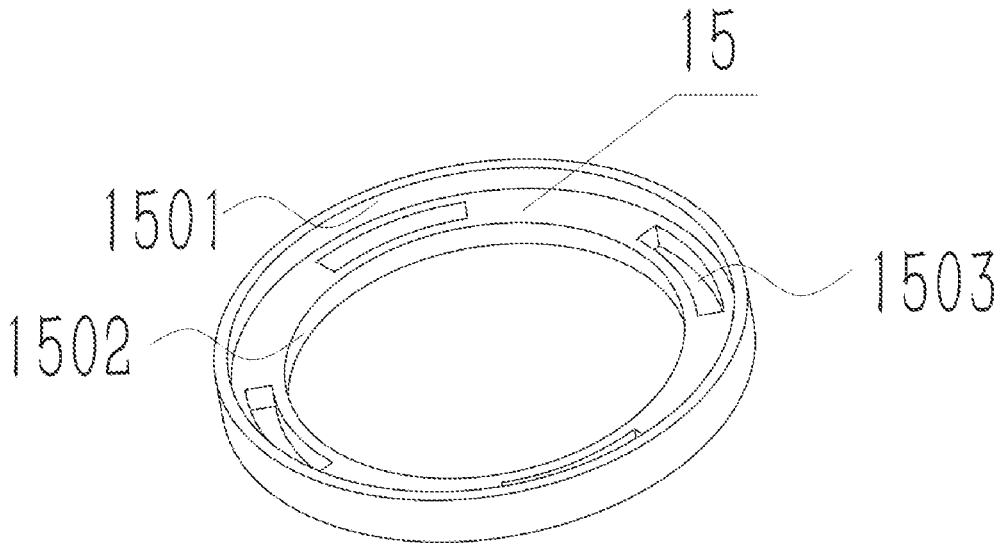
FIG. 9 is an outside view of an upper rubber cylinder according to the present disclosure.
Figure 10:
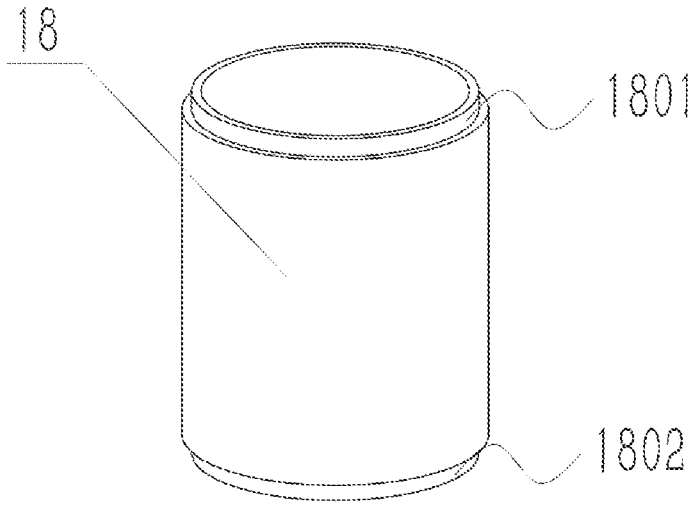
FIG. 10 is an outside view of a connecting cylinder according to the present disclosure.
Figure 11:
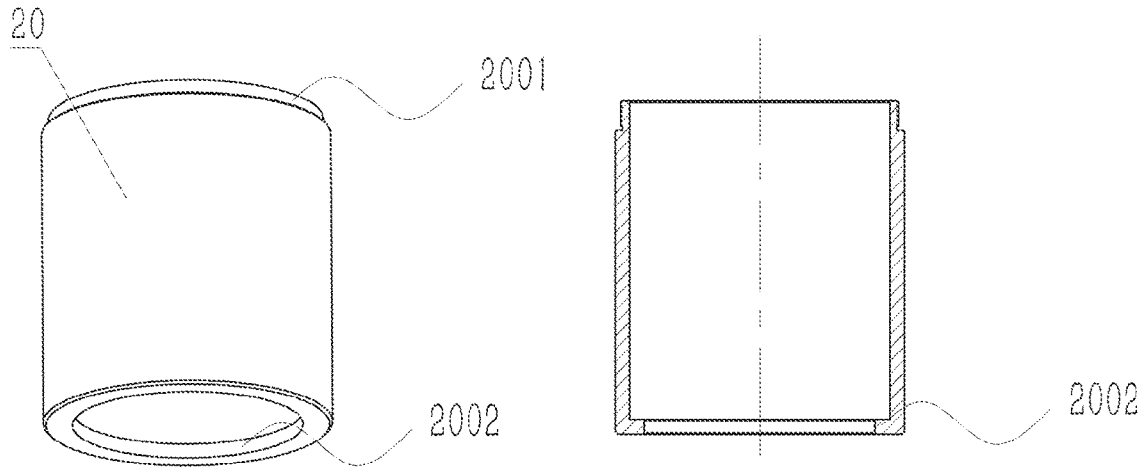
FIG. 11 is a structural schematic diagram of an outer cylinder according to the present invention.
Figure 12:
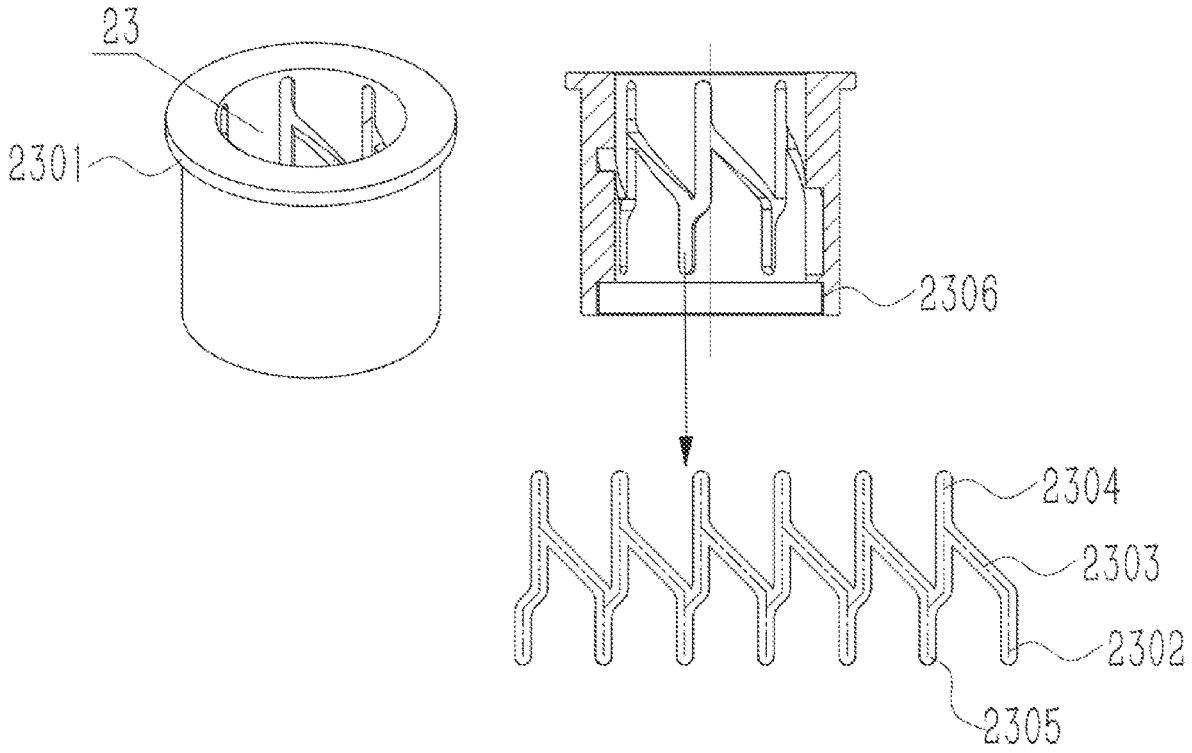
FIG. 12 is a structural diagram of a transposer according to the present disclosure.
Figure 13:
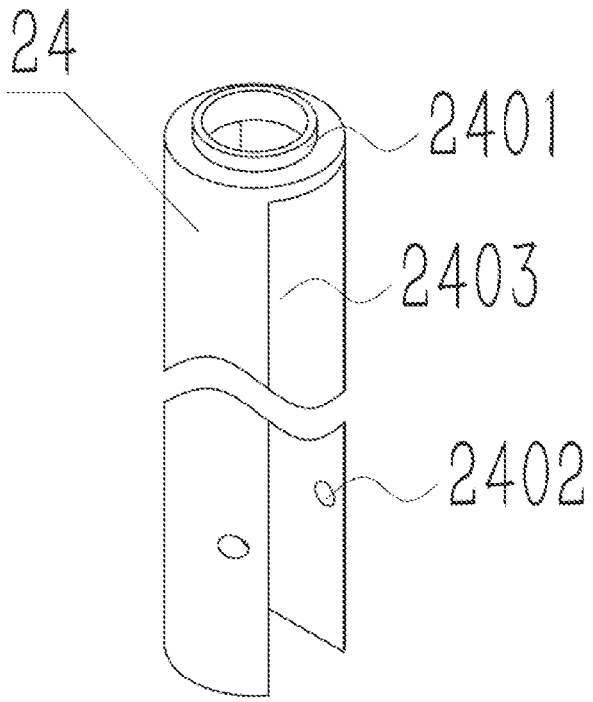
FIG. 13 is an outside view of a steering cylinder frame according to the present disclosure.
Figure 14:
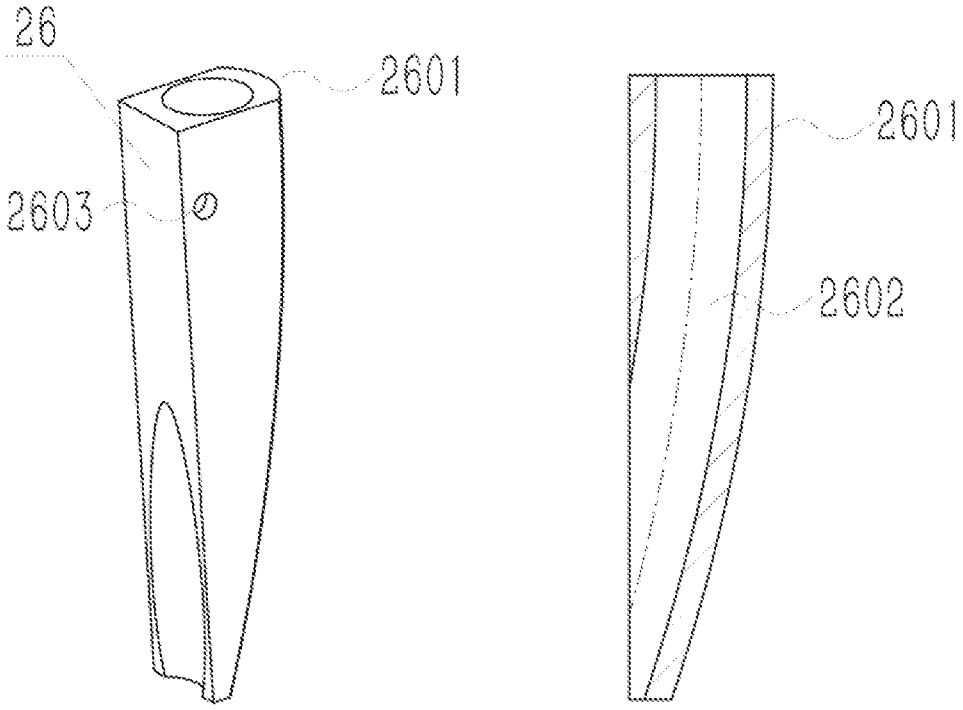
FIG. 14 is a structural schematic diagram of a steering cylinder according to the present disclosure.
Figure 15:
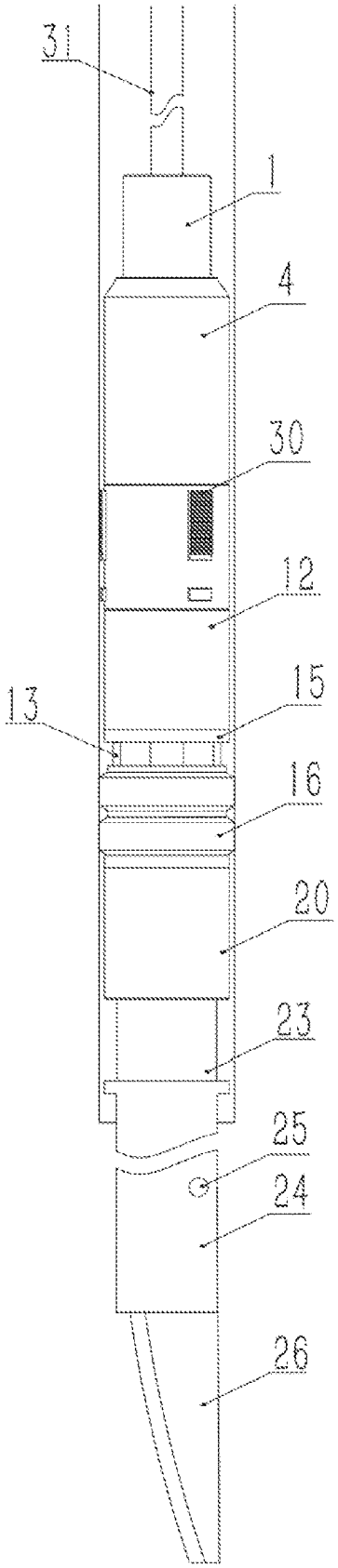
FIG. 15 is a schematic diagram of anchoring and sealing according to the present disclosure.
Figure 16:
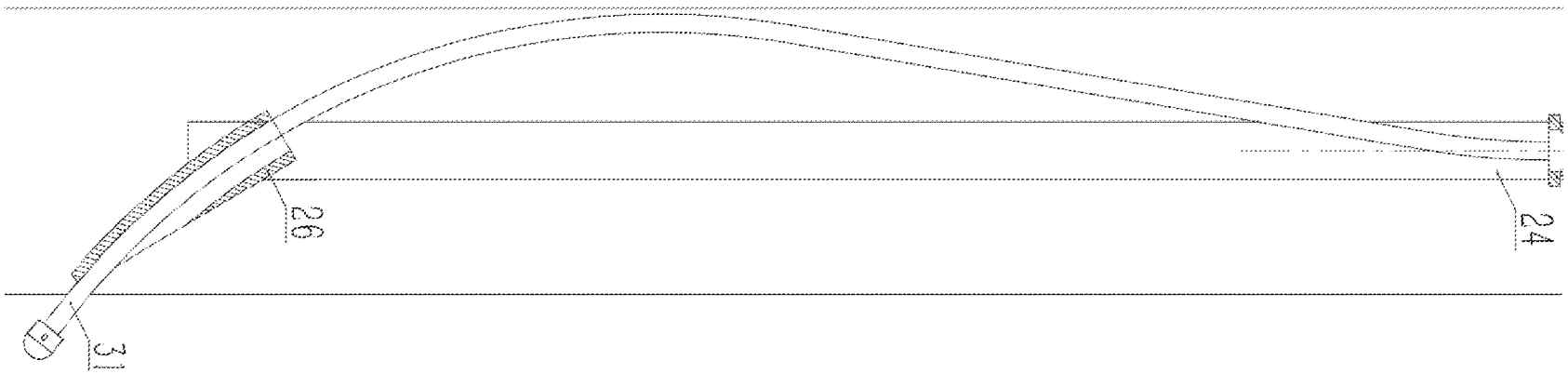
FIG. 16 is a schematic diagram of deflecting according to the present disclosure.
Figure 17:
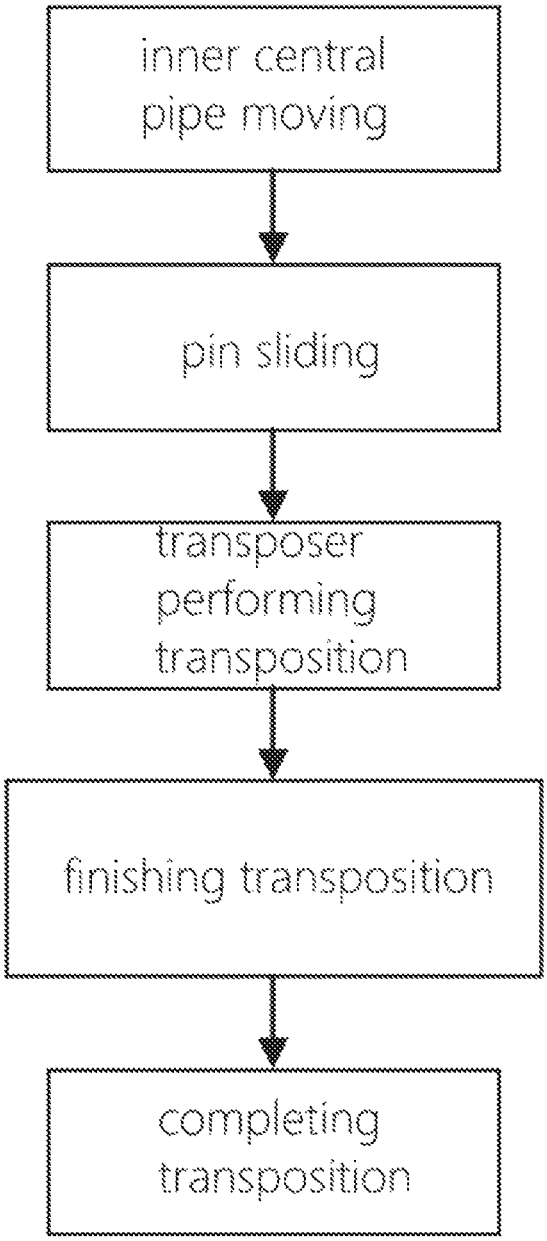
FIG. 17 is a flowchart of a transposition process according to the present disclosure.

As shown in FIGS. 1 to 14, an omni-directional horizontally oriented deflecting tool for a coiled tubing includes an inner central pipe 2, an outer central pipe 1, a cone outer cylinder 4 connected with the outer central pipe 1 through a shear pin I 3, a piston outer cylinder 12 connected with the outer central pipe 1 through a shear pin II 11, an anchoring mechanism, a sealing mechanism, a transposition mechanism and a steering mechanism. An upper part and a middle-lower part of the outer central pipe 1 are provided with threaded holes 101, a middle-upper part and a lower part thereof are provided with circumferential circular through holes 102, and outer walls of a middle part and the lower part thereof are provided with circumferential rectangular grooves 103, an inner side of a lower part of each rectangular groove 103 is provided with a circular hole 104, and a segment of rectangular groove 105 is provided in both sides of a lower part of the outer central pipe 1. The anchoring mechanism includes a cone 7, an O-shaped seal ring I 8, a cone spring 10, a slip 30, a slip spring 29, a slip seat 9, a claw I 5 and a pin shaft I 6. An upper part of the cone 7 is provided with a step 701 and a lower part thereof is provided with a conical surface 703 and is circumferentially provided with three rectangular through grooves 702 uniformly, the cone 7 is installed between the outer central pipe 1 and the cone outer cylinder 4, an outer side of an upper part of the slip seat 9 is provided with external thread I 901, and an inner side of the upper part of the slip seat is provided with two annular grooves 902, and the slip seat is circumferentially provided with three groups of rectangular through grooves 903 and an inner side of the slip seat is provided with three circular grooves 904, the slip seat 9 is connected to the cone outer cylinder 4 through thread, the O-shaped seal ring I 8 is arranged between the slip seat 9 and the cone 7 and the O-shaped seal ring I 8 is installed in the annular groove 902 at the inner side of the upper part of the slip seat 9, the cone spring 10 is arranged between the rectangular through groove 702 of the lower part of the cone 7 and the slip seat 9, the slip 30 is installed in the rectangular through groove 903 of the slip seat 9, and the upper part of the slip 30 is in contact with the conical surface 703 of the lower part of the cone 7, the slip spring 29 is arranged between the slip 30 and the circular groove 904 at the inner side of the slip seat 9, a lower part of the claw I 5 is provided with a through hole 502 and an upper part of the claw is provided with a protrusion 501, and the claw I 5 is installed in the rectangular groove 103 of the middle part of the outer wall of the outer central pipe 1 through the pin shaft I 6. The sealing mechanism includes a piston 13, an O-shaped sealing ring II 14, a claw II 28, a pin shaft II 27, an upper rubber cylinder seat 15, a rubber cylinder 16, a connecting cylinder 18, a lower rubber cylinder seat 19 and a gasket 17. An upper end of the piston 13 is an annular frustum 1301, a lower part of the annular frustum 1301 is provided with four annular bosses 1302 with a certain radian, the piston 13 is sleeved between the outer central pipe 1 and the piston outer cylinder 12, the O-shaped sealing ring II 14 is arranged between the annular frustum 1301 at the upper end of the piston 13 and the piston outer cylinder 12, and the claw II 28 is installed in the rectangular groove 103 of the lower part of the outer wall of the outer central pipe 1 through the pin shaft II 27, an inner side of an upper part of the upper rubber cylinder seat 15 is provided with thread II 1501, and an inner side of the upper rubber cylinder seat is provided with thread III 1502, the upper rubber cylinder seat 15 is provided with four annular through grooves 1503 with a certain radian, the upper rubber cylinder seat 15 is connected to the piston outer cylinder 12 through thread, the annular boss 1302 of the piston is installed in cooperation with the annular through groove 1503 of the upper rubber cylinder seat, an outer side of an upper end of the connecting cylinder 18 is provided with thread IV 1801, and an outer side of a lower end of the connecting cylinder is provided with thread V 1802, the connecting cylinder 18 is sleeved outside the outer central pipe 1 and connected to the upper rubber cylinder seat 15 through thread, the gasket 17 is sleeved outside the connecting cylinder 18 and is in contact with the upper rubber cylinder seat 15, the rubber cylinder 16 is sleeved outside the connecting cylinder 18 and is in contact with the gasket 17, and the lower rubber cylinder seat 19 is connected to the connecting cylinder 18 through thread. The transposition mechanism includes a lower outer cylinder 20, a transposition spring 21, a thrust bearing 22 and a transposer 23, an outer side of an upper end of the lower outer cylinder 20 is provided with thread VI 2001, and a lower end of the lower outer cylinder is provided with a boss 2002, the lower outer cylinder 20 is connected to the lower rubber cylinder seat 19 through thread, the transposition spring 21 is arranged between the outer central pipe 1 and the lower outer cylinder 20, an upper end of the transposition spring is in contact with the lower rubber cylinder seat 19 and a lower end of the transposition spring is in contact with the thrust bearing 22, the thrust bearing 22 is sleeved between the outer central pipe 1 and the lower outer cylinder 20, an outer side of an upper end of the transposer 23 is provided with a step 2301 and an inner side of a lower end of the transposer is provided with thread VII 2306, an inner side of a middle of the transposer is provided with six groups of transposition rails, and each of the six groups of transposition rails includes a rail I 2302, a rail II 2303, a rail III 2304 and a rail IV 2305, the transposer 23 is installed in the lower outer cylinder 20, and an upper end face of the transposer 23 is in contact with a lower end face of the thrust bearing 22. The steering mechanism includes a steering cylinder frame 24, a steering cylinder 26 and a pin shaft III 25. An outer side of an upper end of the steering cylinder frame 24 is provided with thread VIII 2401, a lower end of the steering cylinder frame is provided with a rectangular through groove 2403, and a lower part of the steering cylinder frame is provided with a circular through hole 2402, the steering cylinder frame 24 is connected to a lower end of the transposer 23 by thread, an outer part of the steering cylinder 26 is provided with an arc surface 2601 with a certain curvature, an inner part of the steering cylinder is provided with a circular channel 2602 with a certain curvature, and circular holes 2603 are provided outside of two sides of the steering cylinder, the steering cylinder 26 is installed between the steering cylinder frames 24 through a pin shaft III 25, an upper part and an upper-middle part of the inner central pipe 2 are provided with circumferential circular through holes 201, a middle-lower part and a lower part thereof are provided with circumferential pin holes 202, the pins are installed in the pin holes 202, the pin of the middle-lower part of the inner central pipe 2 are matched with the rectangular groove 105 of the lower part of the outer central pipe 1, the pin of the middle-lower part of the inner central pipe 2 move axially along the rectangular groove 105 of the lower part of the outer central pipe 1, the pin of the middle-lower part of the inner central pipe 2 is installed in cooperation with the transposition track, the pin of the middle-lower part of the inner central pipe 2 slides in the transposition track, and the through hole 201 of the inner central pipe are aligned with the through hole 102 of the outer central pipe.

An operation process of the disclosure is as follows.

Anchoring Process:

The drill bit and the tool are tripped in to a predetermined deflection depth, and drilling fluid is injected into the tool through the coiled tubing and the drill bit 31 to pressurize it. The drilling fluid enters annular spaces between the outer central pipe 1 and the cone outer cylinder 4 and between the outer central pipe 1 and the piston outer cylinder 12 from the inner central pipe 2 through the horizontal through hole 201 and the horizontal through hole 102 of the outer central pipe. The drilling fluid, when pressurized to a certain hydraulic pressure, pushes the cone 7 downward, and hydraulically push the piston 13 placed in the piston outer cylinder 12 downward at the same time. The cone 7 descends to spread the slip 30 to anchor the slip 30 to an inner wall of the casing, and the piston 13 descends to compress the rubber cylinder 16 to expand, thus sealing an annular space between the tool and the casing. When the tool is anchored and sealed, the cone 7 and the piston 13 descend to a certain position. At this time, the claws 5 and 28 installed in the rectangular groove 103 on an outer wall of the outer center tube extend out to grasp the cone 7 and the piston 13, so as to prevent the cone 7 from going upward due to rebound of the lower part of the cone spring 10 and the rubber cylinder 16 from driving the piston 13 to go upward due to its own elastic rebound after compression. At this time, the deflecting tool completes anchoring and sealing, and the tool is fixed at a predetermined depth.

Deflecting Process:

After the anchoring and sealing of the deflecting tool is completed, the coiled tubing and the drill bit 31 are tripped in. Due to flexible characteristics of the coiled tubing and when the drill bit and the coiled tubing 31 are tripped into the circular channel 2602 in the steering cylinder 26, the steering cylinder 26 rotates for a certain angle during continuous tripping in of the drill bit since the steering cylinder 26 is eccentrically arranged, and the coiled tubing bends in a wellbore, so that an advancing direction of the drill bit is deviated from a tool axis so as to achieve a purpose of deflecting.

Drilling Azimuth Changing Process:

When drilling in a certain direction by the drill bit is complete, the coiled tubing and the drill bit 31 are recovered into the deflecting tool and then tripped out, and the coiled tubing and the drill bit 31 will drive the inner central pipe 2 to move axially upward in the outer central pipe 1, and the pin at the lower part of the inner central pipe 2 slides in the rail I 2302 of the transposition rail of the transposer 23. When the pin moves to the rail II 2303 of the transposition rail and since the inner central pipe 2 can only move axially, the pin drives the transposer 23 to rotate when it moves axially upward at the rail II 2303 of the indexing rail. When the pin moves to the rail III 2304, tripping-out of the coiled tubing and the drill bit 31 is stopped, and then the coiled tubing and the drill bit 31 are tripped in, the inner central pipe 2 descends along the rail III 2304 under action of gravity, and the pin wipe in the rail IV 2305 from the rail III 2304. At this time, the tool completes azimuth changing once.

Unsealing Process:

When the casing needs to be taken out for the deflecting tool, the coiled tubing and the drill bit 31 are recovered into the deflecting tool. When the coiled tubing and the drill bit 31 are tripped out continuously, the inner central pipe 2 will be driven upward. When the coiled tubing and the drill bit 31 are tripped out so that the inner central pipe 2 is in contact with an end face of the outer central pipe 1, a tripping-out force may be increased until the shear pins I 3 and II 11 at joints of the outer central pipe 1 and the outer cone tube 4 and of the outer central pipe 1 and the outer piston tube 12 are sheared, and at this time the outer central tube 1 and the cone outer cylinder 4 can axially move relatively. The coiled tubing and the drill bit 31 is continued to be tripped out to drive the inner central pipe 2 and the outer central pipe 1 upward. Because the jaws 5 and 28 are arranged in the outer wall of the outer central pipe 1, when the outer central pipe 1 goes upward, the jaws 5 and 28 also go upward, so the cone 7 goes upward due to rebound of the cone spring 10, the slip 30 is recovered due to rebound of the slip spring 29 between the slip 30 and the slip seat 9, and the piston 13 ascends due to recovery of the compressed rubber cylinder 16, thus effecting unsealing, and extraction of the tool.

What is claimed is:

1. An omni-directional horizontally oriented deflecting tool for a coiled tubing, comprising an inner central pipe, an outer central pipe, a cone outer cylinder connected with the outer central pipe through a shear pin I, a piston outer cylinder connected with the outer central pipe through a shear pin II, an anchoring mechanism, a sealing mechanism, a transposition mechanism and a steering mechanism, wherein an upper part and a lower part of the outer central pipe are provided with two threaded holes, the upper part and the lower part of the outer central pipe are provided with circumferential circular through holes, and outer walls of the upper part and the lower part of the outer central pipe are provided with circumferential rectangular grooves, an inner side of a lower part of each rectangular groove is provided with a circular hole, and a segment of rectangular groove is provided in both sides of a lower part of the outer central pipe, the anchoring mechanism comprises a cone, an O-shaped seal ring I, a cone spring, a slip, a slip spring, a slip seat, a claw I and a pin shaft I, wherein an upper part of the cone is provided with a step and a lower part of the cone is provided with a conical surface and is circumferentially provided with three rectangular through grooves uniformly, the cone is installed between the outer central pipe and the cone outer cylinder, an outer side of an upper part of the slip seat is provided with external thread I, and an inner side of the upper part of the slip seat is provided with two annular grooves, and the slip seat is circumferentially provided with three groups of rectangular through grooves and an inner side of the slip seat is provided with three circular grooves, the slip seat is connected to the cone outer cylinder through thread, the O-shaped seal ring I is arranged between the slip seat and the cone and the O-shaped seal ring I is installed in the annular groove at the inner side of the upper part of the slip seat, the cone spring is arranged between the rectangular through groove of the lower part of the cone and the slip seat, the slip is installed in the rectangular through groove of the slip seat, and the upper part of the slip is in contact with the conical surface of the lower part of the cone, the slip spring is arranged between the slip and the circular groove at the inner side of the slip seat, and the claw I is installed in the rectangular groove of the upper part of the outer wall of the outer central pipe through the pin shaft U;

the sealing mechanism comprises a piston, an O-shaped sealing ring II, a claw II, a pin shaft II, an upper rubber cylinder seat, a rubber cylinder, a connecting cylinder, a lower rubber cylinder seat and a gasket, wherein an upper end of the piston is an annular frustum, a lower part of the annular frustum is provided with four annular bosses with a certain radian, the piston is arranged between the outer central pipe and the piston outer cylinder, the O-shaped sealing ring II is arranged between the annular frustum at the upper end of the piston and the piston outer cylinder, and the claw II is installed in the rectangular groove of the lower part of the outer wall of the outer central pipe through the pin shaft II, an inner side of an upper part of the upper rubber cylinder seat is provided with thread II, and an inner side of the upper rubber cylinder seat is provided with thread III, the upper rubber cylinder seat is provided with four annular through grooves with a certain radian, the upper rubber cylinder seat is connected to the piston outer cylinder through thread, the annular boss of the piston is installed in cooperation with the annular through groove of the upper rubber cylinder seat, the connecting cylinder is arranged outside the outer central pipe and connected to the upper rubber cylinder seat through thread, the gasket is arranged outside the connecting cylinder and is in contact with the upper rubber cylinder seat, the rubber cylinder is sleeved arranged outside the connecting cylinder and is in contact with the gasket, and the lower rubber cylinder seat is connected to the connecting cylinder through thread;

the transposition mechanism comprises a lower outer cylinder, a transposition spring, a thrust bearing and a transposer, wherein the lower outer cylinder is connected to the lower rubber cylinder seat through threads, the transposition spring is arranged between the outer central pipe and the lower outer cylinder, an upper end of the transposition spring is in contact with the lower rubber cylinder seat and the lower end of the transposition spring is in contact with the thrust bearing, the thrust bearing is arranged between the outer central pipe and the lower outer cylinder, an inner side of a middle of the transposer is provided with six groups of transposition tracks, and each of the six groups of transposition tracks comprises a track I, a track II, a track III and a track IV, the transposer is installed in the lower outer cylinder, and an upper end face of the transposer is in contact with a lower end face of the thrust bearing; and the steering mechanism comprises a steering cylinder frame, a steering cylinder and a pin shaft III, wherein the steering cylinder frame is connected to a lower end of the transposer through threads, and the steering cylinder is installed between the steering cylinder frames through a pin shaft, an upper part and a middle part of the inner central pipe are provided with circumferential circular through holes, the middle part and a lower part of the inner central pipe are provided with circumferential pin holes, the pins are installed in the pin holes, the pin of the middle part of the inner central pipe are matched with the rectangular groove of the lower part of the outer central pipe, the pin of the middle part of the inner central pipe move axially along the rectangular groove of the lower part of the outer central pipe, the pin of the inner central pipe is installed in cooperation with the transposition track, the pin of the middle part of the inner central pipe slides in the transposition track, and the through hole of the inner central pipe are aligned with the through hole of the outer central pipe.

2. The omni-directional horizontally oriented deflecting tool for the coiled tubing according to claim 1, wherein a lower part of the claw I is provided with a through hole and an upper part of the claw I is provided with a protrusion.

3. The omni-directional horizontally oriented deflecting tool for the coiled tubing according to claim 1, wherein an outer side of an upper end of the connecting cylinder is provided with thread IV, and an outer side of a lower end of the connecting cylinder is provided with thread V.

4. The coiled tubing omni-directional horizontally oriented deflecting tool according to claim 1, wherein an outer side of an upper end of the lower outer cylinder is provided with thread VI and a lower end of the lower outer cylinder is provided with a boss.

5. The omni-directional horizontally oriented deflecting tool for the coiled tubing according to claim 1, wherein an outer side of an upper end of the transposer is provided with a step and an inner side of the lower end of the transposer is provided with thread VII.

6. The omni-directional horizontally oriented deflecting tool for the coiled tubing according to claim 1, wherein an outer side of an upper end of the steering cylinder frame is provided with thread VIII, a lower end of the steering cylinder frame is provided with a rectangular through groove and a lower part of the steering cylinder frame is provided with a circular through hole.

7. The omni-directional horizontally oriented deflecting tool for the coiled tubing according to claim 1, wherein an outer part of the steering cylinder is provided with a arc surface with a certain radian, an inner part of the steering cylinder is provided with a circular channel with a certain curvature, and circular holes are provided outside of two sides of the steering cylinder.

* * * * *